US005232153A

United States Patent [19]

Mohring et al.

[11] Patent Number: 5,232,153

[45] Date of Patent: Aug. 3, 1993

[54] ARRANGEMENT FOR THE REDUCTION OF THE EXHAUST GAS TEMPERATURE IN HEATING DEVICES

[75] Inventors: Fritz Mohring, Ostfildern; Dieter Maisenbacher, Stuttgart, both of Fed. Rep. of Germany

[73] Assignee: J. Eberspacher, Esslingen, Fed. Rep. of Germany

[21] Appl. No.: 702,079

[22] Filed: May 17, 1991

Related U.S. Application Data

[62] Division of Ser. No. 319,619, Mar. 6, 1989, abandoned.

[30] Foreign Application Priority Data

Mar. 11, 1988 [DE] Fed. Rep. of Germany ..... 3808061

[51] Int. Cl.[5] ..... B60H 1/02

[52] U.S. Cl. ..... 237/12.3 C; 126/110 B

[58] Field of Search ..... 237/12.3 A, 12.3 B, 237/12.3 C, 12.3 R, 2 A; 126/110 B, 110 C

[56] References Cited

U.S. PATENT DOCUMENTS 3,894,526 7/1975 Kofink ..... 126/110 B

*Primary Examiner*—Henry A. Bennet

*Attorney, Agent, or Firm*—McGlew and Tuttle

[57] ABSTRACT

An arrangement for the reduction of exhaust gas discharge temperature and for an increase in efficiency in heating devices is preferably used for the heating of the interior of mobile units. A baffle plate is arranged in an annular chamber defined between a flame tube of the heating device and a heat exchanger surrounding the tube. The baffle plate covers at least a part of the annular chamber on the side where the exhaust gas exit tube is situated The baffle plate can have exhaust gas penetration openings

5 Claims, 2 Drawing Sheets

ARRANGEMENT FOR THE REDUCTION OF THE EXHAUST GAS TEMPERATURE IN HEATING DEVICES

This is a divisional application of application Ser. No. 07/319,619 filed Mar. 6, 1989, now abandoned.

BACKGROUND OF THE INVENTION

1. Field of the Invention

The invention relates particularly to an arrangement of a burner or heater for the reduction of the exhaust gas temperature which includes a combustion chamber which includes a combustion air blower, an electrical ignition device, a flame tube or heating tube and a heat exchanger whose indirect heat surfaces are spaced from and surround the flame tube concentrically, and an outlet tube for the combustion gas.

Linear heating devices are known for use in mobile units, such as motor vehicles, ships or caravans where they serve for the heating of the interior of the passenger spaces. The known heating devices use liquid fuel, preferably the fuel also used in the motor of the unit. The room can either be heated by means of hot air which is immediately blown into the space or indirectly by means of heated water. The water heating devices also allow for the preheating of the motor.

Such a heating device is described in detail in German patent publication 21 39 504. In this publication a heating device is described, which has a single cast metal piece forming the combustion chamber including the heat exchanger having indirect heating surfaces, such as ribs, on both sides of the flame tube and an exhaust gas exit tube. The flame tube is connected to the combustion chamber and protrudes into the heat exchanger part having the ribs. Such a device is designed for the heating of fresh air and serves the heating of the passenger room or space.

Such heating device has disadvantages with regard to the handling of the exhaust gas. The combustion gas exiting from the flame tube and diverted at the heat exchanger wall flows toward the exhaust gas exit tube in the shortest path possible, and only a minor part flows through the annular chamber between the flame tube and the heat exchanger along the ribs which are in the area facing the exhaust gas exit tube. An irregularity in the temperature distribution is the result, and due to the relatively short flow path of the exhaust gas the exhaust gas temperature at the exhaust exit is unnecessarily high.

SUMMARY OF THE INVENTION

The invention provides a heating device having a more regular temperature distribution and therefore a reduction of the exhaust gas temperature and an increase in efficiency of the heat exchanger are achieved.

According to the present invention a heating device includes a baffle plate arranged downstream of an exhaust gas exit tube in an annular chamber between the flame tube and the heat exchanger where the exhaust gas exit tube is formed with or joined to the heat exchanger. Thus, by simple means the exhaust gas is no longer led to the exhaust gas exit tube on the shortest way, but it is forced to flow through the entire annular chamber between the flame tube and the heat exchanger along the indirect heat surfaces such as ribs. This has the advantage that a more even temperature distribution is achieved, and, due to the longer sojourn time of the exhaust gas, the exhaust gas temperature at the exhaust gas exit tube is reduced.

Pertaining to the size of the baffle plate, it has been found practical for it to cover an area in the annular chamber of between 45° and 180°. Herein the range of 120° to 180° is preferred. It has been found that these dimensions optimize the sojourn time of the exhaust gas. With regard to a further development of the invention the baffle plate is mounted to the heat exchanger. For this purpose the baffle plate has an angle by means of which it is slid into the heat exchanger and fixedly connected to it. In a preferred embodiment, wherein the ribs of the heat exchanger are approached, to the baffle plate, the baffle plate can also be mounted directly to the ribs of the heat exchanger. In this case the baffle plate is a simple sheet metal part. Another preferred embodiment is characterized by the fact that the baffle plate has one or more gas penetration openings.

Accordingly, it is an object of the invention to provide an improved space heater and a space heater arrangement in which the combustion gases are directed through a flame tube which has an exit end at the location of a heat exchanger portion which includes ribs which surround the flame tube in a manner such that the combustion gases reverse out of the flame tube and pass through the heat exchanger and out through an exhaust gas connection.

A further object of the invention is to provide a space heater which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DETAILED DESCRIPTION OF THE PREFERRED EMBODIMENT

Figure 1:
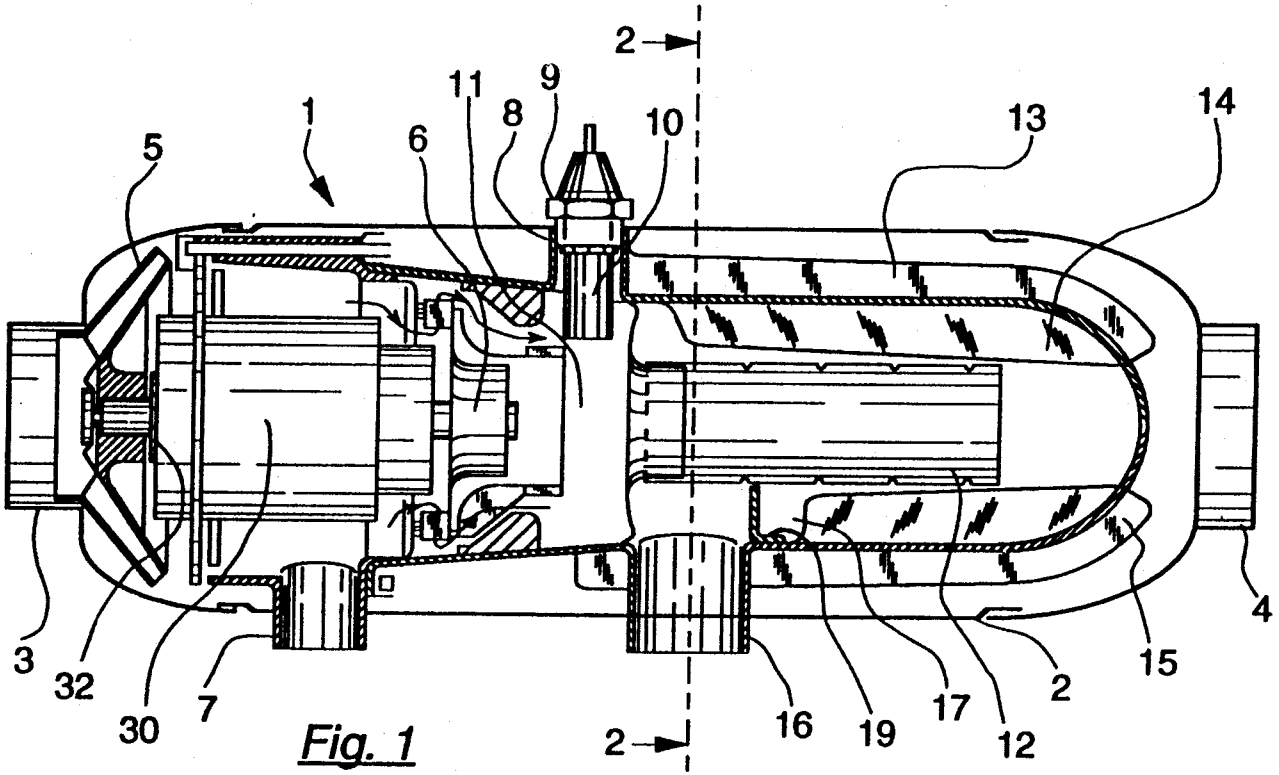
FIG. 1 is an axial sectional view through a heating device.
Figure 2:
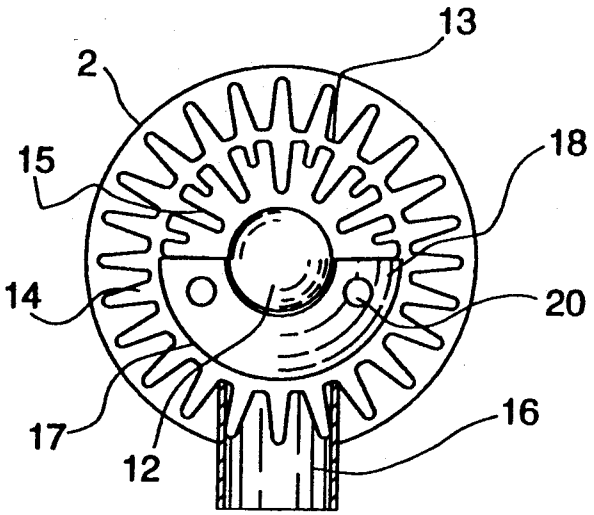
FIG. 2 is a section taken along line 2—2 of FIG. 1.

Referring to the drawings, in particular, the invention therein embodied comprises a space heater 1 which includes a housing having a fresh air inlet 3 for the flow of fresh air around a motor 30 which has a rotatable shaft 32 which drives a fresh air intake fan 5 so that the fresh air flows around the motor and around a heat exchanger portion 13 and exits through a heating gas exit or exhaust gas exit tube 4. In accordance with the invention, the space heater 1 includes the heat exchanger portion 13 which includes axially extending ribs 14 arranged around a flame tube 12 which has an inner end connected into a combustion chamber 11 which is arranged downstream of the motor 30 and is provided with combustion gas supply through a combustion air inlet 7. Fuel and combustion gases or air mix in the combustion chamber 11 and are ignited by an ignition device 9 such as spark plug 10 which is arranged in a spark plug muff or fitting 8. Gaseous products of combustions including the high temperature flame pass through the flame tube 12 reverse at the end the heat exchanger end wall portion 13 and flow through an annular chamber 17 before they exit through the exhaust gas exit 6. A feature of the construction is that a baffle plate 18 is arranged in a lower portion of an annular chamber 17 below the flame tube 12.

According to another embodiment the baffle plate can also be mounted to the flame tube. In this case the flame tube with the baffle plate is mounted to the combustion chamber during the assembly of the heating device.

The heating device shown as an example is similar to that of applicant's German patent 21 39 504 which is a heating device for the heating of the passenger room or space of a motor vehicle with warm air.

The heating device 1 has a metallic housing 2 with an axial fresh air muff or inlet 3 and an axial exhaust gas exit tube 4. A fresh air suction fan 5 rotates with the shaft 32 which also carries a combustion gas blower 6. Both fan 5 and blower 6 are driven by the motor 30 which directs combustion gas entering through the combustion air suction tube 7 into the combustion chamber 11. The fuel is supplied through a spark plug muff 8 which also contains a spark plug or ignition device 9. The prepared, ignitable mixture is ignited and burns in the combustion chamber 11 which is connected to flame tube 12. The flame tube 12 protrudes into the heat exchanger portion 13 having indirect heating surfaces or heating ribs 14 on its outside and having indirect heating surfaces or ribs 15 on its inside. The exhaust gas exits through the exhaust gas exit tube 16. The fresh air sucked in through the fresh air suction tube 3 flows through the heating device 1 and is heated up while flowing through the annular chamber between the housing 2 and the heat exchanger 13 by means of the indirect heating surfaces 15 and leaves the heating device 1 as heating air through the hot air exit tube 4. The fresh air is heated up by the hot combustion gases exiting from the flame tube 12, which is open at its face, and the heated air is diverted at the wall of the heat exchanger 13 and flows through an annular chamber 17 between the flame tube 12 and the heat exchanger 13 with the indirect heat surfaces 14.

In the known device the combustion gas takes the shortest path with the least resistance from the flame tube exit to the exhaust gas exit tube 16, thus impeding both an even flow in the heat exchanger as well as impeding a longer sojourn time for the heat transfer to the fresh air. According to the present invention a baffle plate 18 is therefore arranged downstream of the exhaust gas exit tube 16 in the annular chamber 17 between the flame tube 12 and the heat exchanger 13. The baffle plate 18 covers at least a part (e.g. lower part) of the annular chamber, and preferably half of the annular chamber 17. Preferably, the exhaust gas is forced to flow through a whole portion of the annular chamber 17 and to flow off into the annular chamber half portion and through the exhaust gas exit tube 16. The baffle plate 18 can be fastened to the heat exchanger 13 by means of an angle bracket 19. The inner indirect heating surfaces or ribs 14 of the heat exchanger 13 are shortened in the area of the baffle plate 18. The baffle plate 18 can also be mounted to the ribs 14, thus omitting the angle brackets 19. The mounting is very easy as the baffle plate 18 is merely slid into the heat exchanger 13 and then fastened. The baffle plate 18 can have exhaust gas penetration openings 20 to allow a part of the exhaust gas to flow directly to the exhaust gas exit tube 16. Herein a reduction of the exhaust gas temperature can be optimized in a simple manner by extending the sojourn time of the exhaust gas for the heat transfer.

While specific embodiments of the invention have been shown and described in detail to illustrate the application of the principles of the invention, it will be understood that the invention may be embodied otherwise without departing from such principles.

What is claimed is:

1. A heater, comprising: a heat exchanger portion forming a wall defining a single cavity and an exterior surface; a first plurality of heat exchanger surfaces extending radially into said cavity; a second plurality of heat exchanger surfaces extending radially outwardly from said exterior surface; a heater housing surrounding said heat exchanger portion, said housing cooperating with said heat exchanger portion to define a fresh air heating zone wherein fresh air is directed over said second plurality of heat exchanger surfaces, said heat exchange portion defining an exhaust gas exit extending radially outwardly and passing through said housing; a flame tube extending into said cavity between said first plurality of heat exchanger surfaces, said flame tube having an open end directing hot gas at an end of said cavity, spaced away, with respect to an axial direction of said cavity, from said exhaust gas exit, hot gas emitted from said flame tube being directed at said end of said cavity; and, plate means positioned within said cavity adjacent said exhaust gas exit, said plate means at least partially surrounding said flame tube and acting as a resistance element for increasing the residence time of hot gases within said cavity, said plate means including a plurality of holes formed therein for allowing hot gases to pass therethrough and thereby raising the resistance of flow from said flame tube to said exhaust gas exit.

2. A vehicle heater comprising: a heat exchanger portion forming a wall defining a single cavity and an exterior surface; a first plurality of heat exchanger surfaces extending radially into said cavity; a second plurality of heat exchanger surfaces extending radially outwardly from said exterior surface; a heater housing surrounding said heat exchanger portion, said housing cooperating with said second plurality of heat exchanger surfaces to define a fresh air heating passage wherein fresh air is directed over said second plurality of heat exchanger surfaces, said heat exchange portion defining an exhaust gas exit extending radially outwardly and passing through said housing; a flame tube extending into said cavity between said first plurality of heat exchange surfaces, said flame tube having an open end directing hot gases at an end of said cavity, said open end being spaced away from said exhaust gas exit with respect to an axial direction of said cavity, said flame tube including radial openings facing said first plurality of heat exchanger surfaces; flow resistance means positioned in a single annular space defined between said flame tube and said heat exchanger portion and being positioned between said exhaust gas exit and said end of said cavity for restricting flow of hot gases from said flame tube out of said cavity, said resistance being greatest in a region between said flame tube and said heat exchange portion, directly adjacent said exhaust gas exit and being lowest between said flame tube and said heat exchange portion on the side of said flame tube opposite said exhaust gas exit.

3. A vehicle heater according to claim 2, wherein said resistance means includes openings between said area of maximum resistance and said area of minimum resistance.

4. A heating arrangement according to claim 2 wherein said flow resistance means covers an area between 45° and 180° of said annular space.

5. A heating arrangement according to claim 2 wherein said plate means covers an area between 45° and 180° of said annular space.

* * * * *